US007232271B2

(12) United States Patent
Adams

(10) Patent No.: US 7,232,271 B2
(45) Date of Patent: Jun. 19, 2007

(54) WRITING IMPLEMENT

(75) Inventor: Guy de Warrenne Bruce Adams, Stroud (GB)

(73) Assignee: Hewlett-Packard Development Company L.P., Houston, TX (US)

( * ) Notice: Subject to any disclaimer, the term of this patent is extended or adjusted under 35 U.S.C. 154(b) by 41 days.

(21) Appl. No.: 10/316,005

(22) Filed: Dec. 11, 2002

(65) Prior Publication Data

US 2003/0118391 A1 Jun. 26, 2003

(30) Foreign Application Priority Data

Dec. 14, 2001 (GB) ..... 0129923.9

(51) Int. Cl.
*B43K 24/02* (2006.01)

(52) U.S. Cl. ..... 401/116; 401/99; 401/195

(58) Field of Classification Search ..... 401/116, 401/99, 195, 216, 109, 52, 37, 258–260; 178/18.01, 19.01, 19.03, 19.04, 19.05; 345/179, 345/156, 166

See application file for complete search history.

(56) References Cited

U.S. PATENT DOCUMENTS 5,434,371 A * 7/1995 Brooks ..... 178/19.04
5,939,702 A * 8/1999 Knighton et al. ..... 401/195
6,050,735 A 4/2000 Hazzard
6,536,972 B2 * 3/2003 Bramlett et al. ..... 401/16
2001/0025289 A1 * 9/2001 Jenkins et al. ..... 708/141
2002/0175903 A1 * 11/2002 Fahraeus et al. ..... 345/179

FOREIGN PATENT DOCUMENTS

WO WO 01/61636 A2 8/2001

* cited by examiner

*Primary Examiner*—Khoa D. Huynh
(74) *Attorney, Agent, or Firm*—Foley & Lardner LLP

(57) ABSTRACT

A writing implement 1 includes a sensor 11 and control circuitry 13 so that when the writing implement is brought into close proximity with an input screen, the writing tip 3 of the writing implement 1 is prevented from delivering ink to the input screen. This may be achieved in one embodiment by retracting the writing tip within the body of the writing implement, or by extending a stylus tip 20 beyond the writing tip 3. In other embodiments, ink can be prevented from delivered to the input screen by a mechanism which disengages an ink reservoir 5 from the writing tip 3 of the writing implement 1 and/or, in the case of a ball-point pen type writing tip 3, electromagnets 26 can be arranged to prevent rotation of an ink delivery ball 22.

33 Claims, 2 Drawing Sheets

WRITING IMPLEMENT

Figure 1:
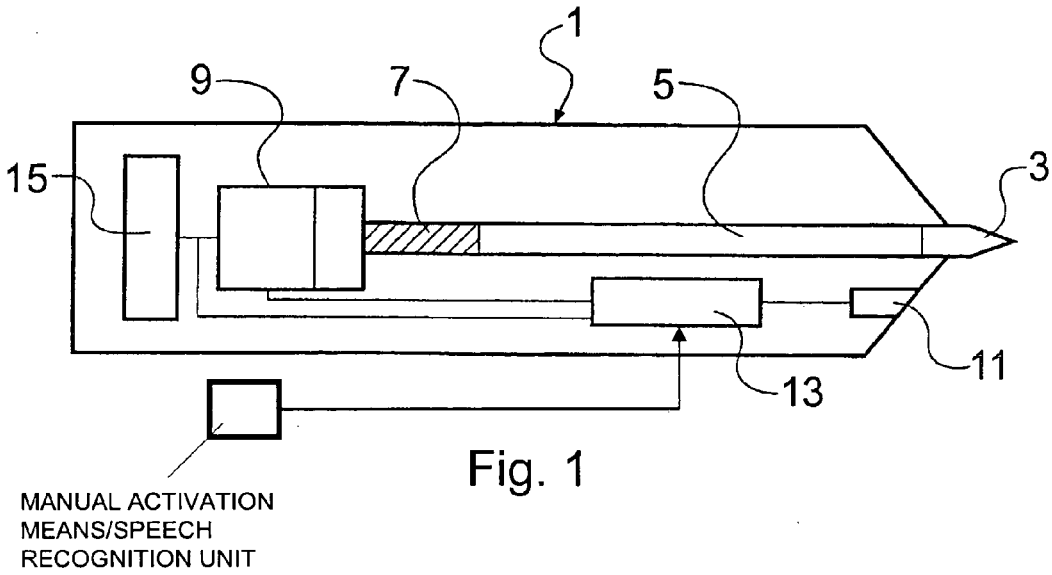

The present invention relates to a writing implement, and in particular a writing implement including detection means for detecting when the writing implement is in close proximity to a particular surface.

A great number of electronic devices utilise an input stylus in conjunction with an input screen as a means for inputting data to the electronic device. One such example is a personal digital assistant, PDA, in which an input stylus is used to input data by bringing the stylus into contact with a touch sensitive input screen. The stylus is used to either select one or more options from a menu displayed on the screen, or is used to directly input data, for example using handwriting or character recognition. A combination of input methods may of course be also used.

The input stylus used in such electronic devices does not operate as a conventional pen and can therefore only be used in conjunction with the intended input screen of the electronic device. Equally it is extremely undesirable to use conventional writing implements, such as a pen, for inputting data to such electronic devices instead of the provided input stylus. This is because not only is it clearly undesirable to deposit ink on the surface of the input screen, but also because the shape and construction of conventional pens make it very likely that they will damage the input screen if used as an input stylus.

This lack of cross functionality between a writing implement and input stylus is particularly disadvantageous for those users that use electronic devices requiring an input stylus at frequent intervals in a working day, but also make use of a conventional writing implement at other times. Such users therefore require two separate input devices, i.e. an input stylus and a conventional writing implement, and must ensure that they use the correct input device at the correct time. There is therefore a requirement for these users to continually swop between the two different types of input devices. Such users therefore perceive a need for an input device that may be used both as a conventional writing implement and as an input stylus suitable for use with a touch sensitive input screen.

Such an input device has been proposed in U.S. Pat. No. 6,050,735. This patent discloses a writing implement that includes an integrally formed stylus tip for inputting information into electronic devices. A conventional cartridge style pen with a push button spring actuator is provided with a stylus tip moulded into the writing end thereof. When the ink cartridge is retracted, the stylus tip is available for use. However, when the ink cartridge is extended, it extends beyond the stylus tip and can thus be used with writing media. A disadvantage with the writing implement described in U.S. Pat. No. 6,050,735 is that manual activation is required to retract the ink cartridge each time it is desired to use the stylus tip. This therefore does not remove the need for a user to remember to perform this manual operation before using the writing implement as an input stylus before inputting data into an electronic device. Should the user forget to retract the ink cartridge before using the writing implement as an input stylus then the same detrimental effects will occur as if a conventional writing implement had been used to input data to the electronic device. In this sense, the writing implement of U.S. Pat. No. 6,050,735 offers very little improvement to users over the use of separate writing implements and input styluses.

International patent application WO01/61636 discloses an electronic pen that includes an optical sensor that is capable of detecting an optical pattern on a specially formatted surface. This allows the position of the pen to be determined, which in turn allows either the pen to be used as a cursor control device or the pen strokes, and thus writing, to be recorded. Although this document discusses using the pen in a non-inking mode such that pen strokes are electronically recorded but no ink mark is made on the formatted surface, it does not contemplate automatically inhibiting ink flow when the pen is brought into contact with a particular surface. Hence the electronic pen disclosed in this application exhibits all of the disadvantages of the known prior art in respect of using the pen as both a writing implement and an input stylus. As no automatic selection of a non-inking mode is performed a user may still inadvertently use the pen as an input stylus whilst the pen is in an inking mode, thus potentially damaging the input screen being used.

According to the present invention there is provided a writing implement comprising: a writing tip arranged to deliver ink to a surface; a sensor arranged to detect when said writing tip is in proximity to a predetermined surface and, when said detection occurs, to generate a control signal; and a mode selection mechanism arranged, in response to said control signal, to automatically prevent said writing tip delivering ink to said predetermined surface.

It is therefore possible to provide a writing implement that combines the functionality of a conventional pen and the functionality of a input stylus whilst automatically detecting the nature of the surface which the writing implement is in proximity to and therefore selecting the appropriate function.

The term 'ink' is used throughout this specification in a generic sense to cover all writing media and therefore includes writing media such as pencil, crayon and gels as well as inks and other coloured fluids or colloids.

Preferably, the mode selection mechanism comprises a retractable stylus tip that is movable between an extended position in which the stylus tip extends beyond the writing tip, and a retracted position.

Alternatively or additionally, the mode selection mechanism may comprise an ink delivery mechanism arranged to prevent delivery of ink to the writing tip in response to the control signal. The ink delivery mechanism may comprise means for retracting the writing tip, or may comprise an ink reservoir arranged to be disengaged from fluid flow communication with said writing tip in response to the control signal thereby preventing ink being delivered to the writing tip. Alternatively, the writing tip may comprise a ball rotatably mounted within the writing tip, the ball being arranged to transfer ink to said surface. In such a case, the means for disabling the writing tip comprises ball restraining means arranged to prevent rotation of the ball.

Preferably, said predetermined surface comprises an input screen of an electronic device. The sensor may comprise a reflectance detector arranged to detect the higher reflectance associated with such input screens. Alternatively, the sensing mechanism may comprise means for detecting a electromagnetic field emitted from an electronic device. Alternatively, the sensing mechanism may include means for detecting polarised light emitted from an electronic device, a capacitive sensor for capacitively detecting the proximity of the electronic device or an inductive sensor.

Preferably, the writing implement includes a power source coupled to said sensing mechanism and said mode selection mechanism. Preferably, said mode selection mechanism is arranged to only draw power from said power source whilst moving said retractable stylus tip between the extended and retracted positions and vice versa. Alternatively or additionally, the mode selection mechanism may be arranged to draw power only when preventing ink flow to the writing tip.

Additionally or alternatively, the writing implement may further comprise manual activation means arranged to manually activate the input mode selection mechanism. The manual activation means may comprise a speech recognition unit, such that the input mode selection mechanism can be activated in response to spoken commands.

According to a second aspect of the present invention there is provided a writing implement in combination with an electronic device, electronic device having an input surface, wherein the writing implement comprises: a writing tip arranged to deliver ink to a writing surface; and a sensing mechanism arranged to detect when said writing tip is in proximity to the input surface of said electronic device and, when said detection occurs to generate a control signal.

Preferably, the electronic device has at least one unique characteristic and said sensing mechanism is arranged to detect the at least one unique characteristic and generate the control signal only when this detection occurs. The writing implement may thus be arranged to only be usable as an input stylus with a particular electronic device, such as a Personal Digital Assistant.

According to a third aspect of the present invention there is provided a method of using a writing implement as an input stylus on an input surface of an electronic device, the writing implement having a writing tip arranged to deliver ink to a surface, the method comprising: sensing the proximity of the writing implement to the input surface; and automatically preventing the writing tip delivering ink to the input surface.

The sensing step may comprise detecting reflected light from the input surface, detecting an electromagnetic field emitted from the input surface, or detecting polarised light emitted from the input surface.

Preferably, the step of preventing the writing tip from delivering ink to the input surface may comprise retracting the writing tip such that the writing tip is prevented from contacting the input surface, extending a stylus tip beyond the writing tip, or preventing fluid communication between an ink reservoir within the writing implement and the writing tip.

According to a fourth aspect of the present invention there is provided a writing implement comprising: a writing tip arranged to deliver ink to a surface; a sensing mechanism arranged to detect when said writing tip is in proximity to a predetermined surface and, when said detection occurs, to generate a control signal; and a warning mechanism arranged, in response to said control signal, to provide a warning signal indicative of the proximity of said writing tip to said surface.

Preferably, the warning signal comprises an audio and/or visual signal.

Figure 2:
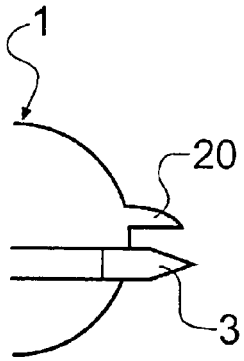
Figure 3:
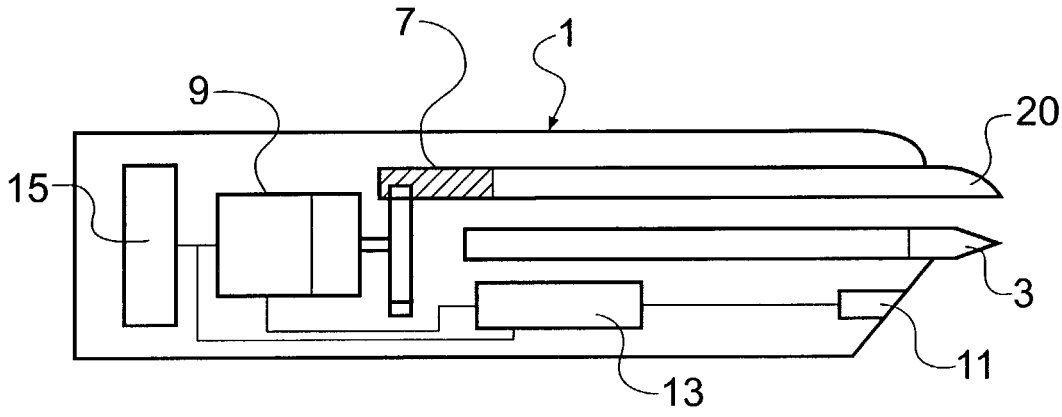
Figure 4:
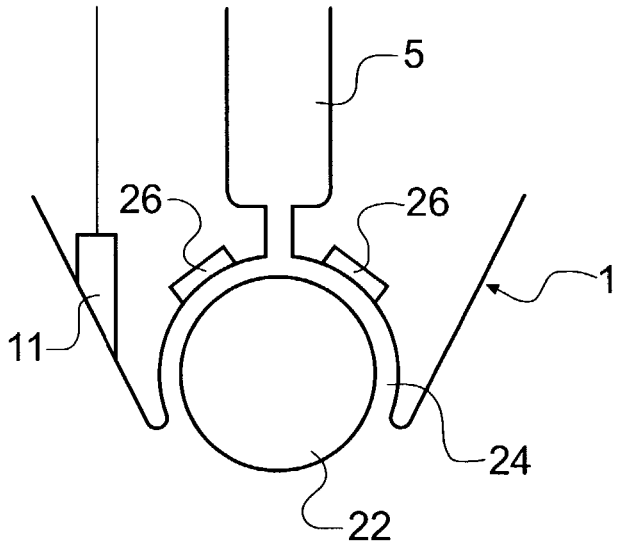

Embodiments of the present invention are described herein, by way of example only, with reference to the accompanying figures, in which:

FIG. 1 schematically illustrates a sectional view of a writing implement according to an embodiment of the present invention;

FIG. 2 shows an enlarged view of the writing tip of an embodiment of the writing implement according to the present invention;

FIG. 3 schematically illustrates a sectional view of a further embodiment of a writing implement according to the present invention; and FIG. 4 illustrates an enlarged sectional view of the writing tip of a writing implement according to an embodiment to the present invention, the writing tip having an ink delivery ball.

An embodiment of the present invention is schematically illustrated in FIG. 1. The writing implement 1 includes a writing tip 3 coupled to an ink reservoir 5, for example as is known with conventional ball-point pen cartridges. As illustrated in FIG. 1, the writing implement 1 is in a first mode of operation such that the writing tip 3 may be brought into contact with the surface of a writing media, such as a piece of paper. Coupled to the ink reservoir at the opposite end to the writing tip 3 is a threaded shaft, or worm screw, 7. The threaded shaft is in turn connected to a motor and gear box assembly 9. The writing implement 1 also includes a sensor 11 mounted in close proximity to the writing tip 3. The sensor 11 is, as shown in FIGS. 1, 3 and 4, a non-contact proximity sensor that is connected to control circuitry 13 that is in turn connected to the motor and gear box assembly 9. A power source 15, for example a lithium ion battery, provides electrical power to both the motor and gear box assembly 9 and the control circuitry 13 and sensor 11.

In operation, the sensor 11 is arranged to provide a signal to the control circuitry 13 when the writing tip 3 of the writing implement 1 is brought into close proximity with the input screen of an electronic device of the type requiring an input stylus to be used in conjunction with the input screen for data entry. The control circuitry 13 is arranged to process the signal from the sensor 11 and to provide a control signal to the motor and gear box assembly 9. On receipt of the appropriate control signal, the motor and gear box assembly provide a rotational output to the threaded shaft 7. By means of a known mechanical linkage (not shown) the rotational movement of the threaded shaft 7 is converted into translational movement and this translational movement is imparted to the ink reservoir 5 and integral writing tip 3. The translational movement causes the writing tip 3 to be retracted within the body of the writing implement 1. This therefore allows the writing implement 1 to be used as an input stylus for the sensed electronic device.

Removal of the writing implement 1 from the proximity of the electronic device is also detected by the sensor 11 and causes a second control signal to be issued by the control circuitry 13 to the motor and gear box assembly 9 in order to rotate the threaded shaft 7 in the opposite direction and to therefore cause the ink reservoir 5 and writing tip 3 to be translated into the extended position as illustrated in FIG. 1.

In preferred embodiments of the present invention, a latch mechanism is provided so as to latch the writing tip 3 in the retracted and extended positions. Provision of a latch mechanism has the consequence that power is only drawn from the power source 15 whilst the writing tip 3 is being moved from the extended position to the retracted position, or vice versa. This avoids unnecessary power drain of the power source 15. It will be appreciated by those skilled in the art that any suitable latching mechanism, either mechanical or electronic, may be utilised. However, in an embodiment of the type hereinbefore described, the resistance of a worm device to being back driven may be sufficient to prevent the need for a latch to be provided.

An enlarged view of the writing tip 3 and surrounding part of the writing implement 1 according to a preferred embodiment of the present invention is shown in FIG. 2. It will be appreciated by those skilled in the art that the provision of a discrete stylus tip, as opposed to merely the absence of the writing tip 3, is more preferable when using the writing implement 1 as an input stylus in conjunction with the input screen of an electronic device. In the embodiment shown in FIG. 2, a stylus tip 20 is integrally provided on the writing implement 1, located in close proximity to the writing tip 3. Therefore, when the writing implement 1 is brought into close proximity to the input screen of an electronic device and the writing tip 3 is retracted as described above with reference to FIG. 1, the stylus tip 20 may now be brought into contact with the input screen of an electronic device. When the writing tip 3 is in the extended position, it extends beyond the stylus tip 20 and the writing implement 1 may therefore be used as a conventional pen.

FIG. 3 shows an alternative, equally preferred, embodiment of a writing implement according to the present invention. The embodiment shown in FIG. 3 has a number of features in common with that of FIG. 1 and, where appropriate, like reference numbers refer to like parts. In the embodiment shown in FIG. 3, the writing tip 3 and associated ink reservoir are mounted in a fixed relationship with respect to the body of the writing implement 1. However, a stylus tip 20 is movably mounted such that the stylus tip 20 may be linearly translated along a longitudinal axis of the writing implement 1. In this embodiment, when the writing implement 1 is not in proximity to an electronic device the stylus tip 20 is in the non-extended position. Hence the writing tip 3 protrudes further than the stylus tip 20 and the writing implement 1 may be used as a conventional pen. However, when the writing implement 1 is moved within proximity to an electronic device of the type previously discussed, the sensor 11 and control circuitry 13 cause a control signal to be sent to the motor and gear box assembly 9, as described above with reference to FIG. 1. Rotational movement of the motor and gear box 9 is transmitted to a threaded shaft 7 such that the rotational movement is translated into linear movement, thus causing the stylus tip 20 to be extended from within the body of the writing implement 1 into a position whereby the stylus tip 20 protrudes further than the writing tip 3. The writing implement 1 may then be used as a input stylus in conjunction with the electronic device. In this particular embodiment of the present invention the mass of the stylus tip 20 is likely to be lower than that of the writing tip and ink reservoir and thus requires less power to be drawn from the power source 15 to translate it between extended and retracted positions. It may also be easier to adapt to existing writing implements.

An enlarged view of the writing tip of a writing implement according to a further embodiment of the present invention is shown in FIG. 4. The writing implement 1 has at its tip a ball 22 that is held within a cup shaped recess 24 such that the ball 22 is freely rotatable and may be brought into contact with the surface of a writing medium. An ink reservoir 5 is in communication with the recess 24 such that as the ball 22 rotates ink is conveyed from the recess 24 to the surface of the writing medium, and further ink is supplied to the recess 24 from the ink reservoir 5. As in the previously discussed embodiments, a sensor 11 is provided at the tip of the writing implement 1 to provide a signal when the writing implement is brought into close proximity with the surface of an input screen of an electronic device. On receipt of the control signal electromagnets 26 located adjacent to the recess 24 are actuated, thereby exerting a magnetic force on the ball 22 that prevents it from rotating. This prevents ink from being deposited by the ball 22 and therefore allows the writing implement 1 to be used as an input stylus. In this embodiment, it is preferred that the ball 22 is of such a size and texture, for example rubber coated, so as to avoid damaging the input screen of the electronic device. The electromagnets 26 may alternatively be substituted by a suitable arrangement of piezoelectric elements located adjacent to the recess 24 such that on receipt of the control signal the piezoelectric elements come into physical contact with the ball 22, thereby preventing further rotation.

In a further alternative embodiment, the ink reservoir 5 may be movable with respect to the writing tip 3 such that a mechanism may be provided in an analogous manner to the mechanism shown in FIGS. 1 and 3 to linearly translate ink cartridge 5 out of engagement with the writing tip 3 when the writing implement 1 comes into close proximity with the input screen of an electronic device. As ink flow to the writing tip is therefore interrupted, the writing implement 1 may then be used as an input stylus for the electronic device. It will be appreciated that this particular embodiment of the present invention may only be suitable where the writing tip 3 is not likely to cause damage to the input screen of the electronic device.

Other features that may be included in embodiments of the writing implement according to the present invention may include visual and/or audible confirmation of the change of mode of operation. A manual switch may also be provided to actuate the change of mode of operation. This may be provided as a manual override switch, or may be integrated into specific grips provided on the body of the writing implement so as to initiate the change of mode of operation in response to a user changing the grip exerted on the writing implement, this being contemplated where the input stylus for a particular electronic device is used in such a manner that a different grip is adopted to that used for a conventional writing implement.

It will also be appreciated by those skilled in the art that although the above discussed embodiments utilise a motor and gear box assembly to effect the linear translation of either the writing tip 3 or stylus tip 20, other suitable mechanisms may be used. For example, the linear translation may be effected using a conventional solenoid. Equally, the worm gear and threaded shaft 7 may be substituted for a cam arrangement. The motor and gear box 9 may also be replaced by suitable pneumatic, hydraulic or piezoelectric mechanisms.

Furthermore, other embodiments of the writing implement according to the present invention may be realised in which the power source 15 is not required or at least not required to provide power for causing displacement of the writing tip or of a stylus. In such embodiments the necessary energy to cause the change of mode of operation maybe mechanically stored energy, for example such as that provided by a spring. For example, the user may be required to tension a spring by depressing a button or moving one of the writing tip or stylus to the ink delivery position prior to the change of mode of operation, such that when the writing implement is brought into proximity with an electronic device the stored energy from the spring is used to effect the change of mode of operation to the mode where delivery on ink is inhibited. The user is then required to re-tension the spring. This is considered to be still advantageous over the prior art because only a single manual operation is required. Alternatively, a clockwork mechanism may be provided which requires retensioning only occasionally.

It will also be appreciated by those skilled in the art that a number of different arrangements of sensors and control circuitry may be used within embodiments of the present invention. For example, it is known that the screens of electronic devices such as personal digital assistants emit an AC voltage/magnetic field that may be detected by a suitable sensor. It is further known that different electronic devices tend to emit characteristic AC voltage/magnetic fields which may therefore permit the writing implement of the present invention to be arranged to be operative only with specific electronic devices. Alternatively, the sensor may be arranged to detect differing reflectance associated with the screens of the electronic devices and the surface of a writing medium. To detect the reflectance from a surface the writing implement of the present invention would also require a light emitter to be mounted within it. The sensor would detect the difference in reflectance, i.e. the fact that the screen of an electronic device is likely to display a high degree of reflectance of incident light, whereas the generally matt surface of a writing medium will not exhibit a very high degree of reflectance. Further alternative sensing arrangements include detecting the presence of polarised light. The liquid crystal display screens of electronic devices, as an inevitable consequence of the use of LCD screens, emit polarised light whereas the light reflected from paper, for example, is not polarised. Furthermore detection schemes may involve the detection of infrared radiation emitted from the screen of an electronic device, the change in capacitive coupling that will occur when the writing implement is brought into proximity with an electronic device, or the change in local inductance, or radiation that will occur when the writing implement comes into proximity with an electronic device.

Other possible embodiments of the present invention include a writing implement having a sensor arrangement as previously discussed but arranged to simply provide an audible and/or visible warning to the user, and not to effect the change of mode of operation automatically. Additionally, the change of mode of operation may be instigated using speech recognition technology and a verbal command given by the user

The invention claimed is:

1. A writing implement in combination with an electronic device, the electronic device having an input surface, wherein the writing implement comprises:

a writing tip arranged to deliver ink to the input surface; and a non-contact proximity sensor arranged to detect when said writing tip is in close non-contact proximity to the input surface of said electronic device and, when said detection occurs, to generate a control signal, to prevent ink delivery to said input surface of said electronic device.

2. The combination of claim 1, wherein said writing implement comprises a mode selection mechanism arranged, in response to said control signal, to automatically prevent said writing tip delivering ink to said input surface.

3. The combination of claim 1, wherein said electronic device has at least one unique characteristic and said sensor is arranged to detect said at least one unique characteristic and generate said control signal only when said detection occurs.

4. The combination of claim 1, wherein said electronic device comprises a Personal Digital Assistant.

5. A method of using a writing implement as an input stylus on an input surface of an electronic device, the writing implement having a writing tip arranged to deliver ink to a surface, the method comprising:

sensing a non-contact proximity of said writing implement to the input surface; and automatically preventing said writing tip delivering ink to said input surface.

6. The method of claim 5, wherein said step of sensing the non-contact proximity to the input surface comprises detecting reflected light from said input surface.

7. The method of claim 5, wherein said step of sensing the proximity to the input surface comprises detecting an electromagnetic field emitted from said input surface.

8. The method of claim 5, wherein said step of sensing the proximity to the input surface comprises detecting polarized light emitted from said input surface.

9. The method as claimed in claim 5, wherein the step of sensing the proximity to the input surface comprises detecting an electromagnetic field emitted from the electronic device.

10. The method of claim 5, wherein the step of preventing said writing tip delivering ink comprises retracting the writing tip whereby the writing tip is prevented from contacting the input surface.

11. The method of claim 5, wherein said step of preventing said writing tip delivering ink to said input surface comprises extending a stylus tip beyond said writing tip.

12. The method of claim 5, wherein said writing implement comprises an ink reservoir in fluid communication with said writing tip and said step of preventing said writing tip delivering ink to said input surface comprises blocking said fluid communication.

13. A writing implement comprising:

a writing tip arranged to deliver ink to a surface;

a non-contact proximity sensor arranged to detect when said writing tip is in non-contact proximity to a predetennined surface and, when said detection occurs, to generate a control signal; and a warning mechanism arranged, in response to said control signal, to provide a warning signal indicative of the non-contact proximity of said writing tip to said surface.

14. The writing implement according to claim 13, wherein said warning signal comprises an audio and/or visual signal.

15. A writing implement comprising:

a writing tip arranged to deliver ink to a surface;

a non-contact proximity sensor arranged to detect when said writing tip is in a predetermined non-contact proximity to a predetermined surface and, when said detection occurs, to generate a control signal; and a mode selection mechanism arranged, in response to said control signal, to automatically prevent said writing tip delivering ink to said predetermined surface.

16. The writing implement according to claim 15, wherein said mode selection mechanism comprises a stylus tip which is movable between an extended position, in which the stylus tip extends beyond the writing tip, and a retracted position.

17. The method of claim 5, wherein said writing implement comprises an ink reservoir in fluid communication with said writing tip and said step of preventing said writing tip delivering ink to said input surface comprises blocking said fluid communication.

18. The writing implement according to claim 15, wherein said mode selection mechanism comprises an ink delivery mechanism arranged to prevent delivery of ink to said writing tip in response to said control signal.

19. The writing implement according to claim 18, wherein said ink delivery mechanism comprises retraction means for retracting said writing tip whereby said writing tip is prevented from contacting said predetermined surface.

20. The writing implement according to claim 18, wherein said ink delivery mechanism comprises an ink reservoir arranged to be movable between a first position in which the ink reservoir is engaged with said writing tip and a second position in which said ink reservoir is disengaged from said writing tip, said ink delivery mechanism being arranged to move said ink reservoir from said first position to said second position in response to said control signal.

21. The writing implement according to claim 19, wherein said writing tip comprises a ball rotatably mounted within a recess within said writing tip, said ball being arranged to deliver ink to a surface on which said ball is translated on, whereby said ink delivery mechanism comprises restraining means arranged to prevent rotation of said ball in response to said control signal.

22. The writing implement according to claim 15, wherein said sensor is further arranged to detect when said writing tip is withdrawn out of proximity to said predetermined surface and, when said further detection occurs, to generate a further control signal.

23. The writing implement according to claim 22, wherein said mode selection mechanism is further arranged, in response to said further control signal to re-enable use of said writing tip.

24. The writing implement according to claim 15, wherein said predetermined surface comprises an input surface of an electronic device.

25. The writing implement according to claim 15, wherein said sensor is arranged to detect reflected light from said input surface.

26. The writing implement according to claim 24, wherein said sensor is arranged to detect an electromagnetic field emitted from said input surface.

27. The writing implement according to claim 24, wherein said sensor is arranged to detect polarized light emitted from said input surface.

28. The writing implement according to claim 15, wherein said writing implement further comprises a power source coupled to said sensor and said mode selection mechanism.

29. The writing implement according to claim 28, wherein the mode selection mechanism comprises a stylus tip movable between an extended position in which the stylus tip extends beyond the writing tip and a retracted position, wherein said mode selection mechanism is arranged to only draw power from said power source whilst moving said stylus tip between said extended and retracted positions.

30. The writing implement according to claim 28, wherein said ink delivery mechanism comprises an ink reservoir arranged to be movable between a first position in which the ink reservoir is engaged with said writing tip and a second position in which said ink reservoir is disengaged from said writing tip, said ink delivery mechanism being arranged to move said ink reservoir from said first position to said second position in response to said control signal, and wherein said mode selection mechanism is arranged to only draw power when preventing ink flow to the writing tip.

31. The writing implement according to claim 15, wherein said writing implement is arranged to generate an audio and/or visual confirmation signal when said control signal is generated.

32. The writing implement according to claim 15, wherein said writing implement further comprises manual activation means arranged to manually activate said mode selection mechanism.

33. The writing implement according to claim 15, wherein said writing implement further comprises a speech recognition unit for allowing a user to activate said mode selection mechanism.

* * * * *